US006634115B2

(12) United States Patent
Gundel et al.

(10) Patent No.: US 6,634,115 B2
(45) Date of Patent: Oct. 21, 2003

(54) CONDITIONING DEVICE TO CHANGE THE MOISTURE CONTENT OF PRINTING STOCK

(75) Inventors: Kai-Michael Gundel, Schlat (DE); Gerhard Klukas, Aichelberg (DE); Andreas Schweizer, Bad Ditzenbach Gosbach (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/028,141

(22) Filed: Dec. 20, 2001

(65) Prior Publication Data

US 2002/0100184 A1 Aug. 1, 2002

(30) Foreign Application Priority Data

Jan. 17, 2001 (DE) ..... 101 01 775

(51) Int. Cl.[7] ..... F26B 19/00

(52) U.S. Cl. ..... 34/71; 34/95; 34/620; 34/629; 34/111

(58) Field of Search ..... 34/69–71, 95, 34/108, 110, 111, 113–123, 620, 623, 629, 329, 335, 343, 355, 397–400

(56) References Cited

U.S. PATENT DOCUMENTS

| | | | | | |
|---|---|---|---|---|---|
| 4,922,627 | A | * | 5/1990 | Hernandez | 34/116 |
| 4,958,444 | A | * | 9/1990 | Rautakorpi et al. | 34/71 |
| 5,385,644 | A | * | 1/1995 | Hannus et al. | 162/207 |
| 5,581,907 | A | * | 12/1996 | Kuma et al. | 34/572 |
| 5,594,997 | A | * | 1/1997 | Lehtinen | 34/95 |
| 5,706,587 | A | * | 1/1998 | Lehtinen et al. | 34/71 |
| 5,722,182 | A | * | 3/1998 | Lehtinen et al. | 34/418 |
| 5,778,555 | A | * | 7/1998 | Lehtinen et al. | 34/71 |
| 5,815,943 | A | * | 10/1998 | Puumalainen | 34/95 |
| 5,822,880 | A | * | 10/1998 | Puumalainen | 34/95 |
| 5,966,834 | A | * | 10/1999 | Steiner et al. | 34/116 |
| 6,158,144 | A | * | 12/2000 | Weber et al. | 34/335 |
| 6,223,450 | B1 | * | 5/2001 | Banerjee | 34/116 |
| 6,240,654 | B1 | * | 6/2001 | Weber et al. | 34/335 |
| 6,303,003 | B1 | * | 10/2001 | Webster | 162/290 |
| 6,351,896 | B1 | * | 3/2002 | Vainio | 34/428 |
| 6,488,816 | B1 | * | 12/2002 | Klerelid | 162/359.1 |

* cited by examiner

*Primary Examiner*—Ira S. Lazarus
*Assistant Examiner*—Andrea M. Ragonese
(74) *Attorney, Agent, or Firm*—Lawrence P. Kessler

(57) ABSTRACT

A conditioning device to change the moisture content of printing stock, in which the stock is brought into contact with at least one endless cloth that absorbs moisture. The endless cloth is heated by heated transport rolls. A reduction of the moisture content contributes to a reduction of distortions of the printing image in two-sided printing, especially in digital printing machines.

11 Claims, 2 Drawing Sheets

CONDITIONING DEVICE TO CHANGE THE MOISTURE CONTENT OF PRINTING STOCK

FIELD OF THE INVENTION

The invention concerns a conditioning device to change the moisture content of printing stock, especially flat paper products, in which the stock is brought into contact with at least one endless cloth that absorbs moisture, the endless cloth being heated by heated transport rolls.

DESCRIPTION RELATIVE TO THE PRIOR ART

EP 0 771 904 concerns a drying device in paper production, in which large amounts of moisture must be removed from the paper. In this case, a paper web is guided past a cloth that absorbs moisture, for example, made of felt, and exposed to infrared radiation in a limited region. At the same time, the moisture emerging from the paper web is drawn into the felt cloth by means of an underpressure from the bottom of the cloth, which contributes to an improvement in drying.

EP 0 078 382 concerns a drying device in offset printing. Infrared emitters are used to evaporate the moisture from paper sheets and a blower is used to blow out the moist air from the paper sheets and, at the same time, cool them.

The moisture content of paper is an important parameter that determines the dimensions of a paper sheet or paper web and therefore has a not insignificant effect on printing quality within a printer. The application of pressure and heat can cause shrinkage of paper stock. This has a particular effect during double-sided printing, if a change in moisture content of the stock occurs between printing of the front and backsides, and a change in size of the stock is caused by this. This produces so-called front-to-back error. This is a regular occurrence in digital printers that use heat and pressure to fix a toner image. This effect can be reduced by predrying of the stock, since only limited shrinkage can still occur, because of the more limited residual moisture content of the stock. An increase in printing quality is achieved on this account.

BACKGROUND OF THE INVENTION

It is therefore the task of this invention to provide an apparatus, in which it is guaranteed that the stock reaches the subsequent processing steps of the printer with a defined geometry and a defined moisture content.

In an advantageous embodiment of the concept underlying the invention, a printing stock is brought in contact with at least one endless cloth that absorbs moisture, which is stretched around a number of transport rolls that serve for movement of the endless cloth, and heated by means of a heating device, so that the moisture within the printing stock also heated by this is transferred to the endless cloth.

In a particularly advantageous variant, the heating device lies within the rolls and heats them from the inside. This avoids a direct effect of the heating device on the printing stock, which can lead to changes, for example, in the printing image or color composition and, in so doing, cause deterioration in printing quality.

Printing stock that comes in contact with the endless cloth heated by the heating device is heated and releases its moisture content to the surroundings, and especially to the endless cloth. The moisture content is further transported within the endless cloth and removed from the cloth at an appropriate site. This is supported by additional contact of the endless cloth with the heated transport rolls, which contribute to evaporation of the moisture from the endless cloth.

In addition to evaporation of the moisture from the endless cloth, an air stream can be generated in a modification of the concept of the invention, especially by a blower, which has at least one flow component directed horizontal to the surface of the endless cloth and is thus guided past the endless cloth. Evaporation of the moisture from the endless cloth is supported by the change in local vapor pressure caused by this. This process can be preferably supported according to the invention in that the endless cloth is dried outside of the contact zone.

In another variant, an air stream generated, in particular, by a blower and having at least one flow component directed perpendicular to the surface of the endless cloth can be guided through the endless cloth and entrain moisture particles, which also contributes to acceleration of drying of the endless cloth. According to the invention, the air stream that is guided through the endless cloth or past the endless cloth will have a temperature deviating from the surrounding temperature, especially an elevated temperature.

In the region of the conditioning device, the paper is advantageously conveyed forward by the mechanical contact between the endless cloth and the printing stock. Alternative methods of conveyance, having a drive on the side of the printing stock facing away from the endless cloth, are also conceivable.

In another advantageous embodiment of the device according to the invention, the printing stock is guided between two identical endless cloths arranged on both sides of the printing stock. This can guarantee a more uniform removal of moisture from the printing stock, since the evaporated moisture here is fully transferred into the endless cloths.

A significant advantage of this embodiment according to the invention is obtained by the fact that costly paper guides drop out. At the same time, relative movement between the printing stock and the endless cloth is reduced by the forward movement, which is transferred by the endless cloths to the printing stock, and contact with stationary paper guides prevented. Because of this, a situation is avoided in which the surface of the printing stock is altered, especially damaged.

It lies within the inventive concept of the device disclosed here that heating of the transport rolls of the endless cloth need not occur uniformly over their width, but can be superimposed with a temperature profile. A variation of the temperature profile in the longitudinal direction can also be simultaneously implemented, in which the power of the heating devices is varied in time, especially in correlation with the format of the printing stock.

In another advantageous variant, an evaporation zone is connected to the tempering zone, in which the printing stock releases moisture, because of its heating, and is cooled based on the released heat of evaporation. Advantageously, guiding of the printing stock can occur in this region through grid-like structures that afford maximum evaporation surface.

In another variant, a cooling device can advantageously be mounted behind the tempering and/or evaporation zone. However, unheated or cooled transport rolls are used. Because of this, a situation can be achieved in which the printing stock, after leaving the cooling device, has essentially the same temperature as before the drying device. It lies within the scope of the concept according to the invention presented here to use the cooling device also for other purposes without a preceding tempering zone, especially for cooling of the printing stock.

Another advantage is obtained from the elasticity, especially compressibility of the endless cloths that absorb the moisture, so that thickness differences of individual types of printing stock are compensated and no corresponding adjustments are therefore necessary or excess loading of the rolls by different thicknesses of the printing stocks can be prevented. By contact of the printing stock with the endless cloth and removal of the evaporated moisture connected with this from the printing stock, traces on the printing stock, like, water spots, are also avoided.

Printing stock is sometimes deformed, especially rolled up, so-called paper curl, by storage or the production process. A further advantage of the device according to the invention lies in the fact that deformed printing stock is kept flat and smooth by close contact with the endless cloths.

Electromagnetic radiation sources, especially infrared radiation sources, can be advantageously used as heating devices to heat the transport rolls. However, other principles for heating the transport rolls are equally conceivable, like, steam, electric heating or others.

Blowers or air nozzles of a wide variety of arrangements and methods of operation can be used as blower devices.

The device according to the invention finds application in digital printers, but can also be used in all other printing machines or other devices that process paper where differences in paper size during passage through the device and its components are to be avoided or at least reduced.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

Figure 1:
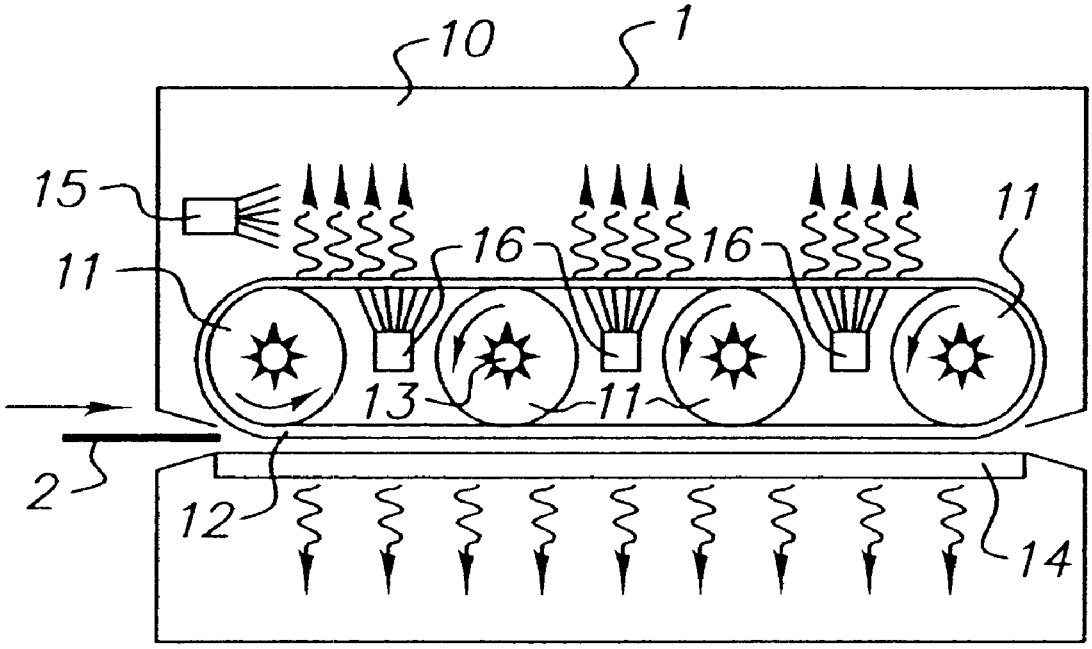
FIG. 1 shows a schematic view of a representative assembly with a conditioning device according to the invention with a tempering zone and an advantageous blower device.

A representative assembly with a conditioning device 1 according to the invention with a tempering zone 10 is shown schematically in FIG. 1. At least two fixed transport rolls 11 are situated within tempering zone 10, over which an endless cloth 12 that absorbs moisture is stretched. The transport rolls 11 are placed in rotation in the same direction individually or in tandem by a drive (not shown). The transport rolls 11 act on the endless cloth 12 that absorbs moisture. A heating device 13 that heats the surrounding transport rolls 11 is situated within one, preferably all, transport rolls 11. The heat generated by the heating device 13 is transferred via transport rolls 11 to the endless cloth 12 that absorbs the moisture.

The printing stock 2 is moved forward through the conditioning device 1 by mechanical contact between printing stock 2 and endless cloth 12.

The printing stock 2 leaves an upstream stock-processing device (not shown) and is guided in friction contact along a grid-like stock guide 14 to the endless moisture-absorbing cloth 12 and thus comes in thermal and mechanical contact with the heated endless moisture-absorbing cloth 12, and is also heated by it. Because of the condition of endless cloth 12 and the pressure between printing stock 2 and endless cloth 12, the moisture in the printing stock 2 is transferred to endless cloth 12. In addition, moisture in printing stock 2 is evaporated by heating of the printing stock 2, which can escape through the grid-like stock guide 14. The moisture absorbed by the endless moisture-absorbing cloth 12 leaves the endless cloth 12 by evaporation on the side facing away from printing stock 2 and the endless cloth 12 is dried.

In an advantageous modification of the invention, a blower 15 is arranged within tempering zone 10, which generates an air stream along the endless moisture-absorbing cloth 12, which has at least one flow component directed horizontally relative to the surface of the endless cloth and, because of this, supports the evaporation process of the endless moisture-absorbing cloth 12 and printing stock 2.

In an alternative, particularly advantageous variant, at least one blower 16, having at least one flow component directed perpendicular to the surface of the endless cloth, is arranged between transport rolls 11, with which tempered air is advantageously blown onto and especially through the endless moisture-absorbing cloth 12. In an advantageous modification of the invention, the blower 16 consists of a number of blower units that are distributed uniformly over the surface between transport rolls 11 and are controlled individually or in groups, and whose power can be adjusted and, in particular, switched off.

Figure 2:
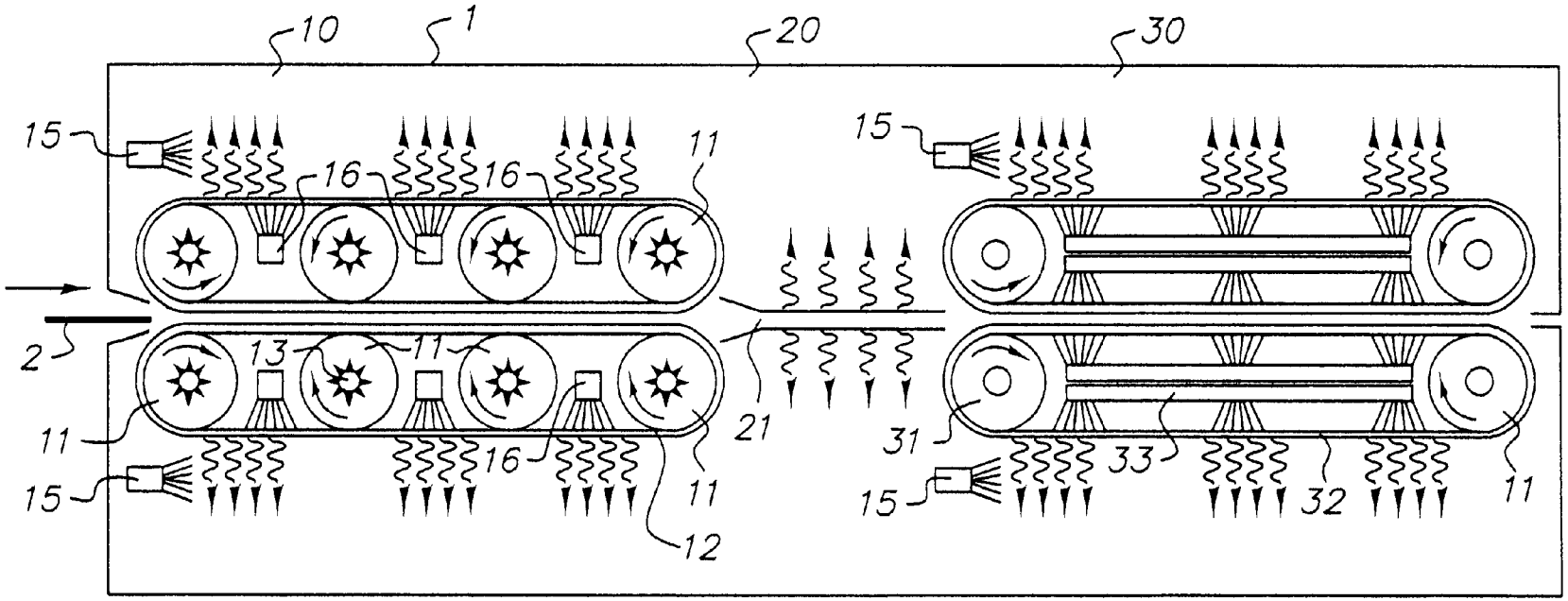
FIG. 2 shows a schematic view of a representative modification of the conditioning device according to the invention with a tempering zone, evaporation zone and cooling zone.

A particularly advantageous modification of the advice of the invention is shown in FIG. 2. Instead of a grid-like stock guide 14, an additional endless moisture-absorbing cloth 12 is arranged here with at least two transport rolls 11 and heating devices 13 on the inside. The printing stock 2 is then conveyed exclusively by the endless cloths 12. Because of the symmetric arrangement, drying of the printing stock 2 can be advantageously improved.

The printing stock 2 is sent from the tempering zone 10 to an evaporation zone 20 and guided by means of a grid-like stock guide 21. Contact rolls or other known mechanisms (not shown) preferably serve as means of transport for printing stock 2. The stock 2 coming from the tempering zone 10 is cooled with further release of moisture because of the released heat of evaporation.

The printing stock 2 in the variant depicted in FIG. 2 is then taken up by an additional pair of endless moisture-absorbing cloths 32 and convey to a cooling zone 30. The cooling zone 30 is designed similar to the tempering zone 10 from transport rolls 31, advantageously two, over which the endless moisture-absorbing cloths 32 are stretched. In this advantageous variant, the additional transport rolls 31 are dispensed with, in order to create the largest possible evaporation region. A blower 33 is arranged between endless cloths 32, which cools the stock 2 by using their released heat of evaporation essentially to the initial temperature of stock 2 before entering the conditioning device 1. The stock 2 is released from the conditioning device 1 following cooling zone 30.

The invention has been described in detail with particular reference to certain preferred embodiments thereof, but it will be understood that variations and modifications can be effected within the spirit and scope of the invention.

Parts list

1 Conditioning device

2 Printing stock

10 Tempering zone

11 Transport roll

12 Moisture-absorbing endless cloth

13 Heating device

14 Grid-like stock guide

15 Blower

16 Blower

20 Evaporation zone

21 Grid-like stock guide

30 Cooling zone

31 Transport roll

32 Moisture-absorbing endless cloth

33 Blower

What is claimed is:

1. Device for conditioning of printing stock (2), comprising:

a tempering zone (10), at least one endless cloth (12) that absorbs moisture, at least two transport rolls (11) in said tempering zone (10), on which the endless cloth is tightened, said at least one endless cloth being adapted to be engaged by printing stock (2), at least one heating device (13), whereby the endless cloth (12) that absorbs moisture is heated and the heating device (13) is situated within the space wrapped around by the endless cloth (12), an evaporation zone (20), characterized by the fact that the evaporation zone (20) being situated behind the tempering zone (10), in which the printing stock (2) is guided, and the printing stock (2) being cooled at least by evaporation of moisture, and a cooling zone (30) situated behind the evaporating zone (20), having at least one endless moisture-absorbing cloth (32) and at least two transport rolls (31).

2. Device according to claim 1, wherein said at least one heating device is arranged within at least one of the transport rolls (11).

3. Device according to claim 1, further including a gridded printing stock guide (14) being formed on the side of the printing stock facing away from the endless cloths (12), and guiding printing stock (2) in the evaporation zone.

4. Device according to claim 1, further including an additional endless moisture-absorbing cloth (12) arranged opposite the transport path of the printing stock (2).

5. Device according to claim 1, further including at least one blower (15) within conditioning device (1), said blower (15) directing an air stream with at least one flow component horizontally relative to the surface of the endless cloth, along the endless moisture-absorbing cloth (12, 32), and therefore evaporates moisture from the endless moisture-absorbing cloth (12, 32).

6. Device according to claim 1, further including at least one blower (16, 33), located between transport rolls (11, 31) in said tempering zone (10) and said cooling zone (30) respectively, producing an air stream having at least one flow component directed perpendicular to, and forced respectively through the surface of the endless cloth of said tempering zone (10) and said cooling zone (30).

7. Device according to claim 1, wherein the endless moisture-absorbing cloth (12, 32) is compressible.

8. Device according to claim 6, whereby at least one of said blowers (15, 16, 17, 33) is heated, such that the air stream generated by said at least one of the blowers (15, 16, 17, 33), arranged within the conditioning device (1), is heated in comparison with the endless moisture-absorbing cloth.

9. Device according to claim 6, wherein the flow rate of the air stream generated by at least one of the blowers (15, 16, 17, 33) within the conditioning device (1) is controllable.

10. Device according to claim 1, wherein each of said heating devices (13) are controllable within at least one transport roll (11), and is disconnectable from its heat source.

11. Device according to claim 1, wherein the moisture content of the printing stock is reduced from about 10% to about 5%.

* * * * *